US006559970B1

(12) United States Patent
Yamamoto et al.

(10) Patent No.: US 6,559,970 B1
(45) Date of Patent: May 6, 2003

(54) MACHINEABLE ENVELOPE ASSEMBLY AND METHOD OF ACCURATELY PRINTING INDICIA ON ENVELOPES

(75) Inventors: Norman Yamamoto, Yorba Linda, CA (US); Anahit Tataryan, Temple City, CA (US); Alan C. Rose, Tarzana, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/694,197

(22) Filed: Oct. 23, 2000

(51) Int. Cl.[7] ..... G06F 15/00

(52) U.S. Cl. ..... 358/1.18; 358/1.12; 281/37; 281/30; 229/69; 229/75

(58) Field of Search ..... 358/1.18, 1.14, 358/1.12, 1.2, 296; 402/79, 80 R; 281/37, 38; 229/69, 75, 80, 313, 68.1

(56) References Cited

U.S. PATENT DOCUMENTS

| | | | | |
|---|---|---|---|---|
| 929,516 A | | 7/1909 | Toliver | 229/69 |
| 1,453,616 A | | 5/1923 | Benenato | 229/69 |
| 1,893,086 A | | 1/1933 | Keller | 229/69 |
| 2,013,844 A | | 9/1935 | Sherman | 229/69 |
| 2,028,341 A | | 1/1936 | Masterson et al. | 229/69 |
| 2,671,602 A | | 3/1954 | Vogt | 383/37 |
| 2,715,493 A | | 8/1955 | Vogt | 229/69 |
| 2,824,686 A | | 2/1958 | Hamilton | 229/69 |
| 3,319,872 A | | 5/1967 | Beckman et al. | 229/69 |
| 3,372,861 A | | 3/1968 | Johnson et al. | 229/80 |
| 3,559,875 A | | 2/1971 | Wilson | 229/69 |
| 3,758,025 A | | 9/1973 | Schafer | 229/69 |
| 3,980,006 A | | 9/1976 | Welch | 93/61 R |
| 4,157,759 A | | 6/1979 | Dicker | 206/610 |
| 4,335,845 A | | 6/1982 | Dierks et al. | 229/69 |
| 4,497,509 A | | 2/1985 | Gore | 282/11.5 A |
| 4,669,652 A | | 6/1987 | Sequin | 229/73 |
| 4,705,297 A | | 11/1987 | Wakeman | 281/2 |
| 4,747,535 A | | 5/1988 | Haase et al. | 229/69 |
| 4,754,915 A | | 7/1988 | Steidinger | 229/92.7 |
| 4,807,805 A | | 2/1989 | Rutkowski | 229/69 |
| 4,878,613 A | | 11/1989 | Badger et al. | 229/75 |
| 5,069,384 A | | 12/1991 | Bell | 229/69 |
| 5,087,238 A | * | 2/1992 | Olson | 493/379 |

(List continued on next page.)

FOREIGN PATENT DOCUMENTS

JP 03227696 A 10/1991

OTHER PUBLICATIONS

Patent Application Publication No. US 2001/0002679 A1, dated Jun. 7, 2001, Titled: Envelope Having Extended Edge for Non–Impact Printer, Inventor: Warren M. Fabel.

*Primary Examiner*—Mark Wallerson
*Assistant Examiner*—Twyler Lamb
(74) *Attorney, Agent, or Firm*—Oppenheimer Wolff & Donnelly LLP

(57) ABSTRACT

A machineable envelope assembly includes an envelope and a strip releasably attached to the envelope. The strip extends out from the envelope flap when the strip lies flat relative to the envelope pocket panels to define with the panels a rectangle having a full letter-size paper width. Thus, when the assembly is in a paper tray of a printer or copier, the assembly is configured and sized to engage both sides of the paper tray, so that the envelope is continually aligned and does not skew during a feeding and printing process in the printer or copier. Thereby the address(es) and/or any PC printed postage are printed straight and accurately positioned in the envelope. The assemblies can be stacked into printer infeed trays and automatically fed therefrom for mass printings and mailings. And after being printed and output by the printer, the strips are peeled off of the envelopes, the paper sheet(s) or other desired contents inserted into the envelopes and the envelope flaps sealed closed.

72 Claims, 4 Drawing Sheets

U.S. PATENT DOCUMENTS

| | | | | |
|---|---|---|---|---|
| 5,415,341 | A | 5/1995 | Diamond | 229/80 |
| 5,474,229 | A | 12/1995 | Shimazaki | 229/69 |
| 5,558,454 | A | 9/1996 | Owen | 402/79 |
| 5,634,587 | A | 6/1997 | Popat et al. | 229/69 |
| 5,743,566 | A | 4/1998 | Hunter et al. | 283/36 |
| 5,755,433 | A * | 5/1998 | Klein | 271/2 |
| 6,004,062 | A | 12/1999 | Hunter et al. | 402/79 |
| 6,071,030 | A | 6/2000 | Hunter et al. | 402/79 |
| 6,233,565 | B1 * | 5/2001 | Lewis et al. | 705/35 |
| 2001/0002679 | A1 * | 6/2001 | Fabel | 229/313 |

* cited by examiner

MACHINEABLE ENVELOPE ASSEMBLY AND METHOD OF ACCURATELY PRINTING INDICIA ON ENVELOPES

BACKGROUND OF THE INVENTION

The present invention relates to constructions of envelopes and envelope systems which can be fed into and printed on by laser and/or ink jet printers, and to methods for feeding of envelopes into a printer or copier for a printing operation thereon.

Many "machineable" envelopes which lend themselves to either laser printers or ink jet printers are in use today. Unfortunately, today's machineable envelopes are subject to "skewing," which results when an envelope travels in a misaligned manner through the printer. This results in the address being typed by the printer in a crooked orientation on the envelope. This misalignment is caused by the envelope, which is aligned with one side of the printer's paper tray, migrating away from that side or edge of the tray during the printing process.

To prevent this skewing the consumer will typically hand feed the envelopes one-at-a-time into the printer. Unfortunately, this is a very time consuming process. Also, the inability to load the paper tray with multiple envelopes prevents large-scale mailings and mail merges wherein a computer program accesses multiple names from a pre-existing database and sends them directly to the printer. Thus, today's envelopes are essentially unusable for large volume mailing applications using personal (PC) printers.

Additionally, an industry is emerging to supply postage over the Internet (see, e.g., www.stamps.com). PC postage allows consumers to print postage-metered labels at their home. Every time a consumer prints a postage label, he is charged for the postage by the PC postage firm; that is, the act of printing triggers the postage charge. Unfortunately, with today's envelopes the postage label must be applied by the printer in a step separate from the address printing step. This is because if the consumer attempts to print directly onto normal envelopes, the above-discussed envelope skewing can cause the print to run off the edge of the envelope. This can result in the stamped envelope not being honored by the Post Office. In other words, the consumer will still be charged by the PC postage firm for the PC postage printed envelope even though the envelope is unacceptable to the Post Office due to the skewed printing of the postage label.

SUMMARY OF THE INVENTION

Accordingly, directed to remedying the above-discussed printer skewing problems which can cause misaligned address printing, misaligned and thus often defective PC postage application, and result in the inability to do high volume mailing using the consumer's PC, disclosed herein are improved envelope assemblies and methods for using same. The envelope assembly includes a traditional envelope, such as a size #10, side seam envelope, and a paper strip (or panel). With the flap of the envelope in an open position, the paper strip is releasably adhered to the inside surface of the flap with the strip extending out and away from the flap and envelope pocket. The strip preferably has the same length as that of the envelope so that the side edges of the strip are aligned with and extend out from the side edges of the envelope. The outward edge of the strip is parallel to the bottom edge of the envelope whereby the strip and envelope together define a rectangle. Since the removable strip (preferably) extends only the length of the envelope, the envelope can be fed from either side of the paper tray, i.e., in multiple directions.

A stack of the envelope assemblies can be stacked into a feed tray and the envelope assemblies automatically fed into the printer or copier and the addresses, postage and/or other desired indicia printed on the envelopes in a single printing step. The printed envelope assemblies are then removed from the printer output trays, the strips peeled off, desired contents inserted in the envelope pocket and the flaps sealed closed.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
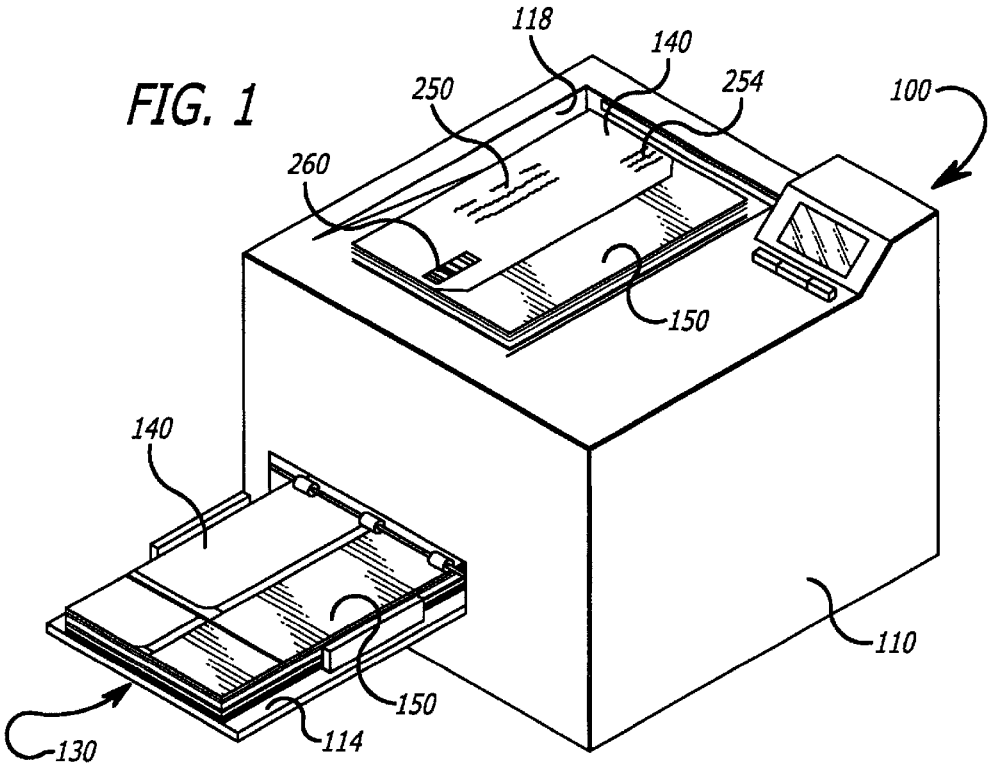
FIG. 1 is a perspective view of a stack of envelope assemblies of the present invention oriented in a first direction and being fed from a feed tray into a printer for a printing operation thereon.

Referring to the drawings, a number of embodiments of the present invention are illustrated and will now be described in detail. FIG. 1 illustrates generally at 100 a system of the present invention. System 100 includes a printer or copier 110 having a feed tray 114 and an output tray 118. The printer or copier 110 can be a personal computer (PC) printer. It can be a laser printer (which prints on high temperature resistant envelopes or other papers), or it can be an ink jet printer (which prints on ink receptive envelopes or other papers). It can also be operatively connected in a known manner to the Internet to access sites which allow the user to print postage metered labels, as described earlier herein. The printer or copier 110 can generally be those available today, those known in the prior art or those to be developed later.

The system 100 further includes an envelope assembly 130 of the present invention. Assembly 130 includes an envelope 140, which can be an envelope currently on the market or one of special design, and an aligning strip (or panel) 150 releasably attached to the envelope, as will be described later in greater detail. Envelope 140 as depicted in the drawings can be an ordinary, commercially available product and includes a front panel 154, a rear panel 158, and a flap 162. The front and rear panels 154, 158 are joined together to form an open top 166 providing access to an envelope pocket 170. The envelope 140 is typically formed of a single sheet of paper which is cut, folded and glued, and has side edges and a bottom edge. The flap 162 has a line of glue 186 on its back surface, which can be covered with a protective strip 190. The strip 190 has a release coating so that when it is desired to seal the flap 162 in a closed position, the strip can be peeled off to expose the glue 186 which is then pressure adhered (without application of moisture) to the rear panel 158. Although the envelope 140 is illustrated in the drawings as a #10, side seam unwindowed, open side envelope, the present invention is not to be so limited. Rather, envelopes 140 herein include generally any type of envelope as would be understood by those skilled in the art and may include other sizes of envelopes, windowed envelopes, top opening envelopes, diagonal seam envelopes, envelopes without adhesive flap sealing, and so forth.

In addition to envelope 140, envelope assembly 130 includes a strip (or panel) 150, which is releasably attached to the envelope so as to stick out above the flap 162. The strip 150 can be a paper such as that disclosed in U.S. Pat. No. 6,004,062, whose entire contents are hereby incorporated by reference. The strip in the '062 patent is disclosed as preferably being twenty-four pound bond paper or equivalent film, having a thickness of approximately 3½ to four mm. The strip 150 of this invention can be about 4½ by 9½ inch rectangle.

Figure 4:
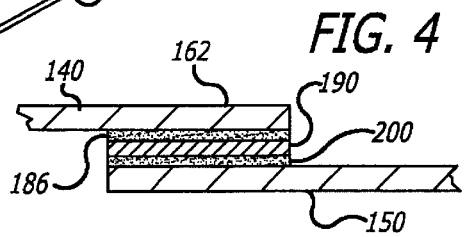
FIG. 4 is an enlarged cross-sectional view taken on line 4—4 of FIG. 3.

The strip 150 can have a layer of adhesive 200, such as shown in FIG. 4, which adheres to the protective strip 190. When the strip 150 is pulled off, it pulls the protective strip 190 with it to expose the glue line 186. The adhesive 200 can be any type of dry tack or pressure sensitive adhesive. Pressure sensitive adhesive (PSA) can be removable or permanent in nature. In case of dry tack and ultra-removable (post-it type) adhesives the flap can be directly attached to the folded carrier sheet without the need for a protective strip.

Figure 5:
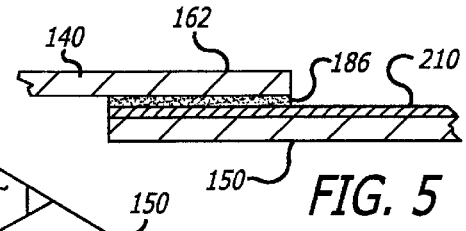
FIG. 5 is a view similar to FIG. 4 illustrating an alternative embodiment of the envelope assembly.

Alternatively, as shown in FIG. 5 the protective strip 190 can be omitted and the strip 150 can have a release coating 210, as depicted in FIG. 5. Coating 210 engages the glue 186 and allows the strip 150 to be pulled off of its flap 162.

Figure 6:
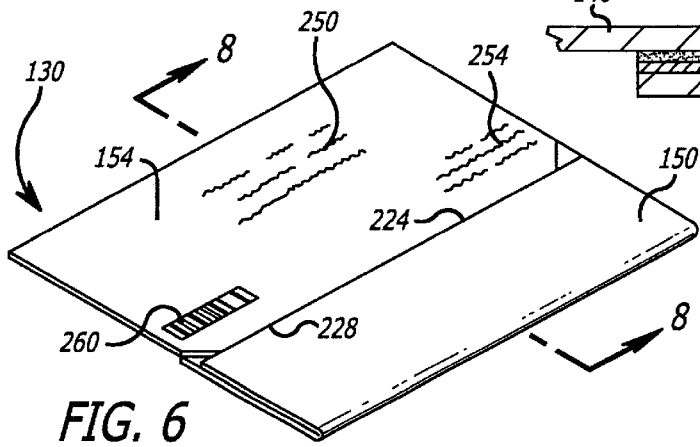
FIG. 6 is a view similar to FIG. 3 illustrating a first alternative embodiment of the envelope assembly of the present invention.
Figure 7:
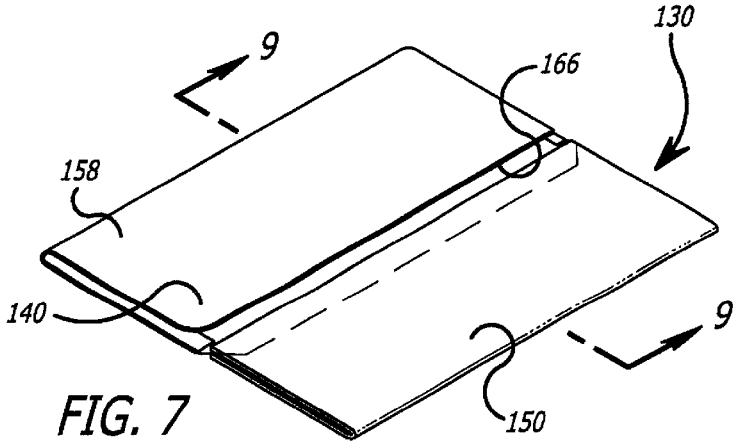
FIG. 7 is a view similar to FIG. 6 illustrating a second alternative embodiment.
Figure 8:
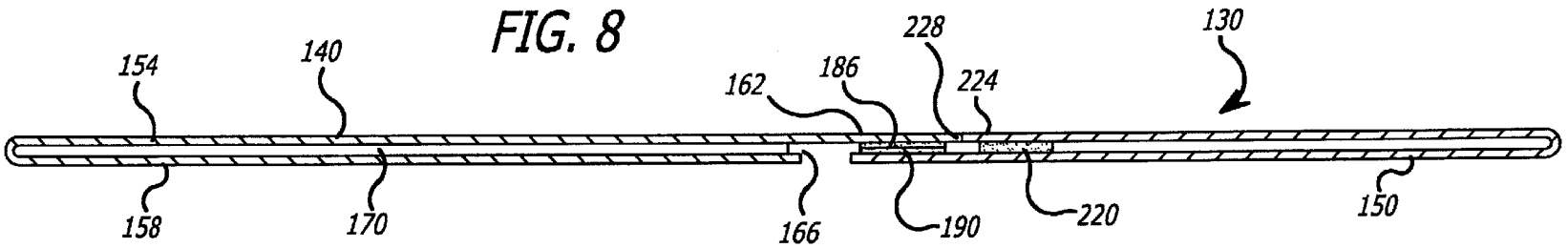
FIG. 8 is an enlarged cross-sectional view taken on line 8—8 of FIG. 6.
Figure 9:
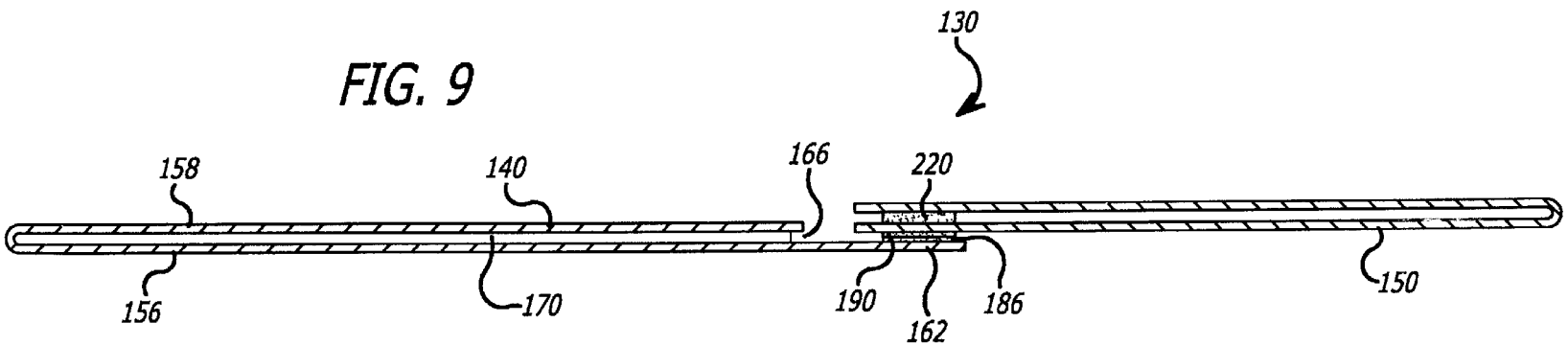
FIG. 9 is an enlarged cross-sectional view taken on line 9—9 of FIG. 7.

When a thick stack of envelope assemblies 130 is in a feed tray 114, the assemblies will tend to tilt a slight amount, which may affect feeding efficiency. This is because the envelopes are two layer (front and rear panels 154, 158) and thus are thicker than the single layer strip 150. One solution is to have the strip 150 be thicker—maybe twice as thick. Another solution is for the strip 150 to be folded over onto itself and maybe held in the folded over position with glue 220. One way to fold it over is shown in FIGS. 6 and 8, where it is folded over onto the front and the strip edge 224 aligned and abutting the flap edge 228. Another arrangement is depicted in FIGS. 7 and 9 wherein the strip 150 is folded to the back side with the strip edge aligned with the flap edge. An advantage of this arrangement is that the folded-over strip portion lies generally in the same plane as the rear panel 158.

The removable strip 150 preferably only extends the length of the envelope 140. This allows the envelope 140 to be fed from either side of the paper feed tray 114. That is, the envelope 140 is printable in multiple directions. If, as a comparison, the strip 150 were to extend a full eleven inches and go beyond one side of the envelope, this side of the envelope could not be aligned with the side of its paper tray 114. This would make the envelope feedable in only one envelope direction, rendering it unusable for software programs and PC printers which require printing in the opposite direction. A full-length removable strip 150 would thus require two versions of envelopes, one with either the left or right sides of the envelope in line with the edge of the eleven-inch removable strip.

The preferred design of the envelope assembly 130, as pictured in the drawing figures, with the removable strip 150 corresponding to the length of the envelope 140 can subsequently be used by a wider variety of printers, thus requiring only a single envelope assembly configuration. FIG. 1 illustrates the envelope assembly 140 in an envelope portrait-feed direction in the printer feed tray, and FIG. 2 shows a landscape feed orientation.

Figure 2:
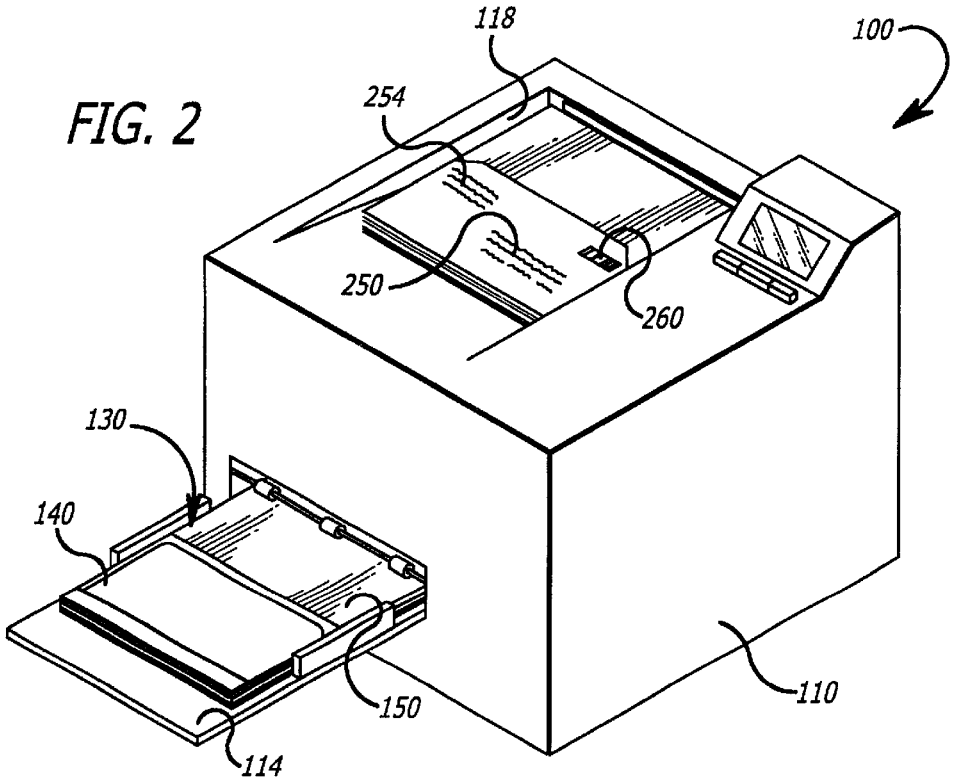
FIG. 2 is a view similar to FIG. 1 but showing the stack of envelope assemblies oriented in a different second direction.
Figure 3:
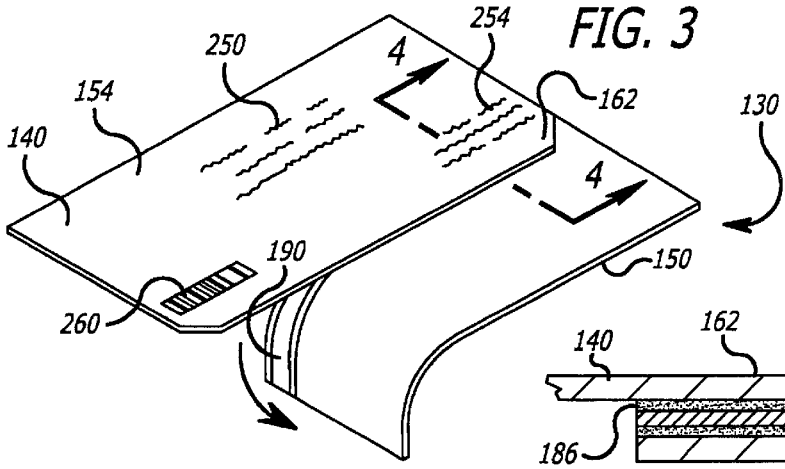
FIG. 3 is a perspective view of an envelope assembly after a printing operation thereon by a printer of FIG. 1 (or 2), and illustrating the strip thereof being peeled off by the user.

FIGS. 1 and 2 show the (mass) printed envelope assemblies 130 in the output trays 118 of the printers 110. The printer indicia (e.g., mailing address 250, return address 254 and/or postage 260, or any desired indicia) is printed accurately and evenly on the envelope front panel 154 because the strip 150 prevents skewed feeding. The envelope assembly 130 thus can be stack loaded into the PC printer paper tray and used in large volume PC printer mailing applications.

Figure 10:
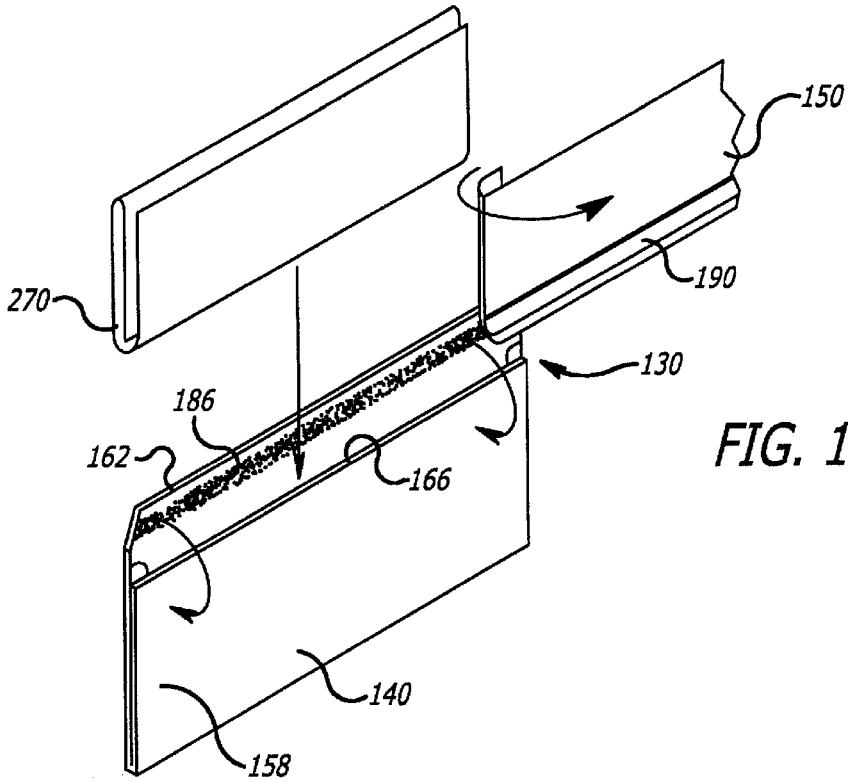
FIG. 10 is a perspective view of the envelope assembly of FIG. 3 illustrating, after a printing operation thereon, the strip being removed and a folded sheet (or other envelope content) being inserted into the envelope pocket and the envelope flap being folded down and adhered in the closed position with the flap adhesive.

The printed envelope assemblies are removed by the user from the printer output tray 118. Referring to FIG. 10, the strip 150 is peeled off, the desired contents (e.g., a folded letter 270) are inserted into the open envelope top and the flap 162 is folded down and sealed closed against the rear panel. The adhesive can be an adhesive which requires moisture (e.g., licking) or one that does not.

Figure 11:
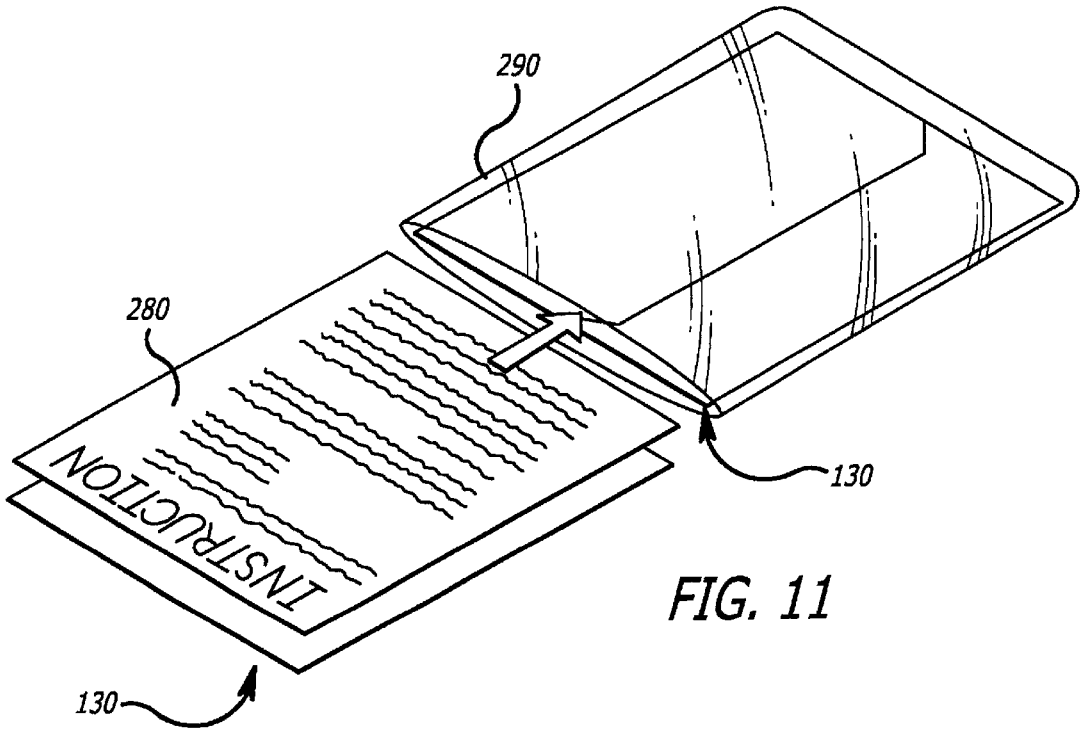
FIG. 11 shows a retail package containing a stack of the envelope assemblies of the present invention together with an instruction (or advertising) sheet.

The envelope assembly 130 can be provided to the consumer in a stack with an optional instruction sheet 280 in retail packaging 290, such as clear plastic bag or a thin cardboard box, as shown in FIG. 11.

From the foregoing detailed description, it will be evident that there are a number of changes, adaptations and modifications of the present invention which come within the province of those skilled in the art. The scope of the invention includes any combination of the elements from the different species or embodiments disclosed herein. However, it is intended that all such variations not departing from the spirit of the invention be considered as within the scope thereof.

What is claimed is:

1. A machineable envelope assembly, comprising:

an envelope having a front panel, a rear panel and a foldable flap, the front and rear panels being secured together and having an open top so that a pocket is defined and contents can be inserted into and removed from the pocket through the open top, the foldable flap being foldable and securable to the rear panel to close the open top after the envelope has been passed through a printer or copier and a printing operation performed thereon; and a strip releasably attached to the envelope and extending out from the flap when lying out flat relative to the panels to define together with the envelope the machineable envelope assembly wherein the assembly when in a paper tray of the printer or copier uses both sides of the paper tray for alignment and does not skew during a feeding process of the printer or copier, the machineable envelope assembly having a rectangular perimeter, and the envelope and the strip each forming at least part of and together forming the entire rectangular perimeter;

wherein the strip comprises a sheet which is folded over on itself to thereby define a two layer construction having a thickness more closely approximating the thickness of the front and rear panels.

2. The assembly of claim 1 wherein the sheet is folded to the rear of the envelope.

3. The assembly of claim 1 wherein the sheet is folded to the front of the envelope.

4. The assembly of claim 1 wherein the sheet is held with adhesive in its folded over position.

5. A machineable envelope assembly, comprising:

an envelope having a front panel, a rear panel and a foldable flap, the front and rear panels being secured together and having an open top so that a pocket is defined and contents can be inserted into and removed from the pocket through the open top, the foldable flap being foldable and securable to the rear panel to close the open top after the envelope has been passed through a printer or copier and a printing operation performed thereon; and a strip releasably attached to the envelope and extending out from the flap when lying out flat relative to the panels to define together with the envelope the machineable envelope assembly wherein the assembly when in a paper tray of the printer or copier uses both sides of the paper tray for alignment and does not skew during a feeding process of the printer or copier, the machineable envelope assembly having a rectangular perimeter, and the envelope and the strip each forming at least part of and together forming the entire rectangular perimeter;

wherein the envelope assembly has a full letter-size paper width of 8½ inches.

6. A machineable envelope assembly, comprising:

an envelope having a front panel, a rear panel and a foldable flap, the front and rear panels being secured together and having an open top so that a pocket is defined and contents can be inserted into and removed from the pocket through the open top, the foldable flap being foldable and securable to the rear panel to close the open top after the envelope has been passed through a printer or copier and a printing operation performed thereon; and a strip releasably attached to the envelope and extending out from the flap when lying out flat relative to the panels to define together with the envelope the machineable envelope assembly wherein the assembly when in a paper tray of the printer or copier uses both sides of the paper tray for alignment and does not skew during a feeding process of the printer or copier, the machineable envelope assembly having a rectangular perimeter, and the envelope and the strip each forming at least part of and together forming the entire rectangular perimeter;

wherein the strip is folded over on itself when the assembly is in the feed tray to define a strip double thickness approximating the thickness of the front and rear panels.

7. The assembly of claim 6 further comprising adhesive holding the strip in the folded over position.

8. A machineable envelope assembly, comprising:

an envelope having a front panel, a rear panel and a foldable flap, the front and rear panels being secured together and having an open top so that a pocket is defined and contents can be inserted into and removed from the pocket through the open top, the foldable flap being foldable and securable to the rear panel to close the open top after the envelope has been passed through a printer or copier and a printing operation performed thereon; and a strip releasably attached to the envelope and extending out from the flap when lying out flat relative to the panels to define together with the envelope the machineable envelope assembly wherein the assembly when in a paper tray of the printer or copier uses both sides of the paper tray for alignment and does not skew during a feeding process of the printer or copier, the machineable envelope assembly having a rectangular perimeter, and the envelope and the strip each forming at least part of and together forming the entire rectangular perimeter;

wherein the strip has a thickness greater than the thickness of either of the panels and approximating the thickness of the front plus rear panels.

9. A machineable envelope assembly, comprising:

an envelope having a front panel, a rear panel and a foldable flap, the front and rear panels being secured together and having an open top so that a pocket is defined and contents can be inserted into and removed from the pocket through the open top, the foldable flap being foldable and securable to the rear panel to close the open top after the envelope has been passed through a printer or copier and a printing operation performed thereon; and a strip releasably attached to the envelope and extending out from the flap when lying out flat relative to the panels to define together with the envelope the machineable envelope assembly wherein the assembly when in a paper tray of the printer or copier uses both sides of the paper tray for alignment and does not skew during a feeding process of the printer or copier, the machineable envelope assembly having a rectangular perimeter, and the envelope. and the strip each forming at least part of and together forming the entire rectangular perimeter;

wherein the envelope has side edge folds and a bottom edge fold, and the strip has side edges which are aligned with respective ones of the side edge folds and a distal end edge which is perpendicular to and extends between the side edges, the distal end edge being parallel to the bottom edge fold, whereby the envelope and the strip define a rectangle;

wherein the rectangle is 9½ by 8½ inches;

wherein the strip is folded over onto and secured to itself to form a two-layer construction having a total thickness approximating that of the two panel envelope.

10. The assembly of claim 9 wherein the assembly has a full letter-size paper width.

11. A machineable envelope assembly, comprising:

an envelope having a front panel, a rear panel and a foldable flap, the front and rear panels being secured together and having an open top so that a pocket is defined and contents can be inserted into and removed from the pocket through the open top, the foldable flap being foldable and securable to the rear panel to close the open top after the envelope has been passed through a printer or copier and a printing operation performed thereon, the foldable flap having an outer flap edge; and a strip releasably attached to the envelope and extending a distance out from the outer flap edge and away from the panels when lying out flat relative to the panels to define together with the envelope the machineable envelope assembly wherein the assembly when in a paper tray of the printer or copier uses both sides of the paper tray for alignment and does not skew during a feeding process of the printer or copier;

wherein the strip comprises a sheet which is folded over on itself to thereby define a two layer construction having a thickness more approximating the thickness of the front and rear panels.

12. The assembly of claim 11 wherein the sheet is folded to the rear of the envelope.

13. The assembly of claim 11 wherein the sheet is folded to the front of the envelope.

14. The assembly of claim 11 wherein the sheet is held with adhesive in its folded over position.

15. A machineable envelope assembly, comprising:

an envelope having a front panel, a rear panel and a foldable flap, the front and rear panels being secured together and having an open top so that a pocket is defined and contents can be inserted into and. removed from the pocket through the open top, the foldable flap being foldable and securable to the rear panel to close the open top after the envelope has been passed through a printer or copier and a printing operation performed thereon, the foldable flap having an outer flap edge; and a strip releasably attached to the envelope and extending a distance out from the outer flap edge and away from the panels when lying out flat relative to the panels to define together with the envelope the machineable envelope assembly wherein the assembly when in a paper tray of the printer or copier uses both sides of the paper tray for alignment and does not skew during a feeding process of the printer or copier;

wherein the envelope assembly has a full letter-size paper width of 8½ inches.

16. A machineable envelope assembly, comprising:

an envelope having a front panel, a rear panel and a foldable flap, the front and rear panels being secured together and having an open top so that a pocket is defined and contents can be inserted into and removed from the pocket through the open top, the foldable flap being foldable and securable to the rear panel to close the open top after the envelope has been passed through a printer or copier and a printing operation performed thereon, the foldable flap having an outer flap edge; and a strip releasably attached to the envelope and extending a distance out from the outer flap edge and away from the panels when lying out flat relative to the panels to define together with the envelope the machineable envelope assembly wherein the assembly when in a paper tray of the printer or copier uses both sides of the paper tray for alignment and does not skew during a feeding process of the printer or copier;

wherein the strip is folded over on itself when the assembly is in the feed tray to define a strip double thickness approximating the thickness of the front and rear panels.

17. The assembly of claim 16 further comprising adhesive holding the strip in the folded over position.

18. A machineable envelope assembly, comprising:

an envelope having a front panel, a rear panel and a foldable flap, the front and rear panels being secured together and having an open top so that a pocket is defined and contents can be inserted into and removed from the pocket through the open top, the foldable flap being foldable and securable to the rear panel to close the open top after the envelope has been passed through a printer or copier and a printing operation performed thereon, the foldable flap having an outer flap edge; and a strip releasably attached to the envelope and extending a distance out from the outer flap edge and away from the panels when lying out flat relative to the panels to define together with the envelope the machineable envelope assembly wherein the assembly when in a paper tray of the printer or copier uses both sides of the paper tray for alignment and does not skew during a feeding process of the printer or copier;

wherein the strip has a thickness greater than the thickness of either of the panels and approximating the thickness of the front plus rear panels.

19. A machineable envelope assembly, comprising:

an envelope having a front panel, a rear panel and a foldable flap, the front and rear panels being secured together and having an open top so that a pocket is defined and contents can be inserted into and removed from the pocket through the open top, the foldable flap being foldable and securable to the rear panel to close the open top after the envelope has been passed through a printer or copier and a printing operation performed thereon, the foldable flap having an outer flap edge; and a strip releasably attached to the envelope and extending a distance out from the outer flap edge and away from the panels when lying out flat relative to the panels to define together with the envelope the machineable envelope assembly wherein the assembly when in a paper tray of the printer or copier uses both sides of the paper tray for alignment and does not skew during a feeding process of the printer or copier;

wherein the envelope has side edge folds and a bottom edge fold, and the strip has side edges which are aligned with respective ones of the side edge folds and a distal end edge which is perpendicular to and extends between the. side edges, the distal end edge being parallel to the bottom edge fold, whereby the envelope and the strip define a rectangle;

wherein the rectangle is 9½ by 8½ inches;

wherein the strip is folded over onto and secured to itself to form a two-layer construction having a total thickness approximating that of the two panel envelope.

20. The assembly of claim 19 wherein the assembly has a full letter-size paper width.

21. A printing system, comprising:

a printer or copier having a feed tray; and an envelope assembly which includes an envelope and a strip releasably attached to the envelope and extending out from a flap of the envelope, the envelope assembly having a rectangular perimeter, and the envelope and the strip each forming at least part of and together forming the entire rectangular perimeter, the envelope assembly being positioned in the feed tray in position for feed into the printer or copier for a printing operation on the envelope;

wherein the envelope assembly has a full letter-size paper width.

22. The system of claim 21 wherein the envelope assembly engages both sides of the feed tray for even aligned feeding into the printer or copier.

23. The system of claim 21 wherein the envelope assembly is positioned in the feed tray stacked with a stack of similar envelope assemblies.

24. The system of claim 21 wherein the envelope assembly is positioned in the feed tray with the envelope oriented in a portrait feed direction.

25. The system of claim 21 wherein the envelope assembly is positioned in the feed tray with the envelope oriented in a landscape feed direction.

26. The system of claim 25 wherein the envelope assembly is positioned for feeding the strip end thereof first and the envelope end last into the printer or copier.

27. The system of claim 25 wherein the printer or copier is a personal computer printer.

28. The system of claim 21 wherein the printer or copier is an ink jet printer.

29. The system of claim 21 wherein the printer or copier is a laser printer.

30. The system of claim 21 wherein the strip is adapted to be peeled off of the flap of the envelope after the printing operation.

31. The system of claim 21 wherein the printer or copier is operatively connected to the Internet and the printing operation includes PC postage printing on the envelope.

32. A machineable envelope assembly, comprising:

an envelope having a front panel, a rear panel and a foldable flap, the front and rear panels being secured together and having an open top so that a pocket is defined and contents can be inserted into and removed from the pocket through the open top, the foldable flap being foldable and securable to the rear panel to close the open top, the foldable flap being foldable and securable to the rear panel to close the open top, the foldable flap being foldable and securable to the rear panel to close the open top after the envelope has been passed through a printer or copier and a printing operation performed thereon; and a strip releasably attached to the envelope and extending out from the flap when lying out flat relative to the panels for aligning the envelope in a printer tray of a printer or copier, for preventing skewing of the envelope during a feeding process into the printer or copier and for maintaining the same print field on the envelope as if the envelope were passed through the printer or copier and indicia were printed in the print field with no strip attached to the envelope, wherein the strip is folded over onto and secured to itself to form a two-layer construction having a total thickness approximating that of the two panel envelope.

33. The assembly of claim 32 wherein the strip extends a full length of the envelope.

34. The assembly of claim 32 wherein the foldable flap includes adhesive on an inside surface thereof which adheres the foldable flap to the rear panel when the flap is folded down on the rear panel after the printing operation.

35. The assembly of claim 34 wherein the strip includes a release coating which engages the adhesive with the strip attached to the envelope and allows the strip to be peeled off of the envelope after the printing operation.

36. The assembly of claim 34 further comprising a cover strip on the adhesive of the foldable flap and the strip being adhered to the cover strip.

37. The assembly of claim 36 wherein the cover strip is adhered to the flap and is removed therewith when the strip is peeled off of the foldable flap after the printing operation.

38. The assembly of claim 37 wherein the adhesive on the foldable flap is a line of adhesive extending the entire length of the foldable flap.

39. The assembly of claim 32 wherein the strip comprises a flat sheet of single-ply paper.

40. A machineable envelope assembly, comprising:

an envelope having a front panel, a rear panel and a foldable flap, the front and rear panels being secured together and having an open top so that a pocket is defined and contents can be inserted into and removed from the pocket through the open top, the foldable flap being foldable and securable to the rear panel to close the open top, the foldable flap being foldable and securable to the rear panel to close the open top, the foldable flap being foldable and securable to the rear panel to close the open top after the envelope has been passed through a printer or copier and a printing operation performed thereon; and strip means releasably attached to the envelope and extending out from the flap when lying out flat relative to the panels for aligning the envelope in a printer tray of a printer or copier, for preventing skewing of the envelope during a feeding process into the printer or copier and for maintaining the same print field on the envelope as if the envelope were passed through the printer or copier and indicia were printed in the print field with no strip means attached to the envelope.

41. The assembly of claim 40 wherein the strip means includes a strip which extends a full length of the envelope.

42. The assembly of claim 40 wherein the foldable flap includes adhesive on an inside surface thereof which adheres the foldable flap to the rear panel when the flap is folded down on the rear panel after the printing operation.

43. The assembly claim 42 wherein the strip means includes a strip and a release coating which engages the adhesive with the strip attached to the envelope and allowing the strip to be peeled off of the envelope after the printing operation.

44. The assembly of claim 42 further comprising a cover strip on the adhesive of the foldable flap and the strip being adhered to the cover strip.

45. The assembly of claim 44 wherein the cover strip is adhered to the flap and is removed therewith when the strip is peeled off of the foldable flap after the printing operation.

46. The assembly of claim 45 wherein the adhesive on the foldable flap is a line of adhesive extending the entire length of the foldable flap.

47. The assembly of claim 40 wherein the strip comprises a flat sheet of single-ply paper.

48. A machineable envelope assembly, comprising:

an envelope having a front panel, a rear panel and a foldable flap, the front and rear panels being secured together and having an open top so that a pocket is defined and contents can be inserted into and removed from the pocket through the open top, the foldable flap being foldable and securable to the rear panel to close the open top, the foldable flap being foldable and securable to the rear panel to close the open top, the foldable flap being foldable and securable to the rear panel to close the open top after the envelope has been passed through a printer or copier and a printing operation performed thereon; and a strip releasably attached to the envelope and extending out from the flap when lying out flat relative to the panels to define together with the envelope the machineable envelope assembly wherein the assembly when in a paper tray of the printer or copier uses both sides of the paper tray for alignment and does not skew during a feeding process of the printer or copier, the machineable envelope assembly having a rectangular perimeter, and the envelope and the strip forming at least part of and together forming the entire rectangular perimeter.

49. The assembly of claim 48 wherein the strip extends a full length of the envelope.

50. The assembly of claim 48 wherein the foldable flap includes adhesive on an inside surface thereof which adheres the foldable flap to the rear panel when the flap is folded down on the rear panel after the printing operation.

51. The assembly of claim 50 wherein the strip includes a release coating which engages the adhesive with the strip attached to the envelope and allowing the strip to be peeled off of the envelope after the printing operation.

52. The assembly of claim 48 further comprising a cover strip on the adhesive of the foldable flap and the strip being adhered to the cover strip.

53. The assembly of claim 52 wherein the cover strip is adhered to the flap and is removed therewith when the strip is peeled off of the foldable flap after the printing operation.

54. The assembly of claim 53 wherein the adhesive on the foldable flap is a line of adhesive extending the. entire length of the foldable. flap.

55. The assembly of claim 48 wherein the strip comprises a flat sheet of single-ply paper.

56. A machineable envelope assembly, comprising:

an envelope having a front panel, a rear panel and a foldable flap, the front and rear panels being secured together and having an open top so that a pocket is defined and contents can be inserted into and removed from the pocket through the open top, the foldable flap being foldable and securable to the rear panel to close the open top, the foldable flap being foldable and securable to the rear panel to close the open top, the foldable flap being foldable and securable to the rear panel to close the open top after the envelope has been passed through a printer or copier and a printing operation performed thereon; and a strip releasably attached to the envelope and extending out from the flap when lying out flat relative to the panels to define together with the envelope the machineable envelope assembly wherein the assembly when in a paper tray of the printer or copier uses both sides of the paper tray for alignment and does not skew during a feeding process of the printer or copier, the machineable envelope assembly having a rectangular perimeter, and the envelope and the strip forming at least part of and together forming the entire rectangular perimeter, the strip defining two corners of the rectangular perimeter, and the envelope defining the other two corners of the rectangular perimeter, and the two corners of the strip and the two corners of the envelope being aligned to form the straight edges of the rectangular perimeter.

57. The assembly of claim 56 wherein the strip extends a full length of the envelope.

58. The assembly of claim 56 wherein the foldable flap includes adhesive on an inside surface thereof which adheres the foldable flap to the rear panel when the flap is folded down on the rear panel after the printing operation.

59. The assembly claim 58 wherein the strip includes a release coating which engages the adhesive with the strip attached to the envelope and allowing the strip to be peeled off of the envelope after the printing operation.

60. The assembly of claim 56 further comprising a cover strip on the adhesive of the foldable flap and the strip being adhered to the cover strip.

61. The assembly of claim 60 wherein the cover strip is adhered to the flap and is removed therewith when the strip is peeled off of the foldable flap after the printing operation.

62. The assembly of claim 61 wherein the adhesive on the foldable flap is a line of adhesive extending the entire length of the foldable flap.

63. The assembly of claim 56 wherein the strip comprises a flat sheet of single-ply paper.

64. An envelope printing method, comprising:

providing an envelope assembly which includes:

(a) an envelope having a front panel, a rear panel and a foldable flap, the front and rear panels being secured together and having an open top so that a pocket is defined and contents can be inserted into and removed from the pocket through the open top, the foldable flap being foldable and securable to the rear panel to close the open top; and (b) a strip releasably attached to the envelope and extending out from the flap when lying out flat relative to the panels to define together with the envelope the machineable envelope assembly, the machineable envelope assembly having a rectangular perimeter, and the envelope and the strip each forming at least part of and together forming the entire rectangular perimeter;

positioning the envelope assembly in a feed tray of a printer or copier so that the assembly engages and is aligned by both sides of the feed tray for non-skewed feeding of the envelope assembly into the printer or copier and thereby accurately placed printing of desired indicia on the envelope maintaining the same print field on the envelope as if the envelope were passed through the printer or copier and indicia were printed in the print field with no strip attached to the envelope; and after the printing, removing the strip from the envelope.

65. The method of claim 64 wherein the removing includes peeling the strip off of the flap.

66. The method of claim 64 wherein the positioning includes positioning a stack of the envelope assemblies in the feed tray, and the non-skewed feeding includes automatic feeding of the top most envelope assembly from a stack of envelope assemblies in the feed tray into the printer or copier.

67. The method of claim 64 wherein the feeding includes feeding the envelope assembly with the envelope in a portrait direction into the printer or copier.

68. The method of claim 64 wherein the feeding includes feeding the envelope assembly with the envelope in a landscape direction into the printer or copier.

69. The method of claim 68 wherein the feeding includes feeding the envelope assembly into the printer or copier strip end first and envelope end last.

70. The method of claim 64 further comprising after the printing, positioning desired envelope contents into the envelope pocket.

71. The method of claim 70 further comprising after the positioning and the removing, sealing the flap closed.

72. The method of claim 64 wherein the envelope assembly has a full letter-size paper width of 8½ inches.

* * * * *